US009273698B2

(12) United States Patent
Murador et al.

(10) Patent No.: US 9,273,698 B2
(45) Date of Patent: Mar. 1, 2016

(54) FAN UNIT FOR A HEAT EXCHANGER

(71) Applicant: Johnson Electric S.A., Murten (CH)

(72) Inventors: Francesco Murador, Asti (IT); Valentino Tenco, Santa Vittoria d'Alba (IT)

(73) Assignee: JOHNSON ELECTRIC S.A., Murten (CH)

( * ) Notice: Subject to any disclaimer, the term of this patent is extended or adjusted under 35 U.S.C. 154(b) by 540 days.

(21) Appl. No.: 13/720,489

(22) Filed: Dec. 19, 2012

(65) Prior Publication Data

US 2013/0156572 A1 Jun. 20, 2013

(30) Foreign Application Priority Data

Dec. 19, 2011 (IT) ..... TO2011U0141

(51) Int. Cl.

| | |
|---|---|
| ***F04D 29/64*** | (2006.01) |
| ***F04D 29/60*** | (2006.01) |
| ***F01P 5/06*** | (2006.01) |
| ***F01P 11/10*** | (2006.01) |
| *F01P 5/04* | (2006.01) |

(52) U.S. Cl.

CPC ..... *F04D 29/646* (2013.01); *F01P 5/06* (2013.01); *F01P 11/10* (2013.01); *F04D 29/601* (2013.01); *F01P 2005/046* (2013.01)

(58) Field of Classification Search

CPC ..... F04D 29/646; F04D 29/601; F01P 5/06; F01P 11/10; F01P 2005/046; F05B 2240/55

USPC ..... 416/169

See application file for complete search history.

(56) References Cited

U.S. PATENT DOCUMENTS

| | | | | | |
|---|---|---|---|---|---|
| 4,329,946 | A * | 5/1982 | Longhouse | 123/41.49 |
| 4,396,221 | A * | 8/1983 | Morgan et al. | 296/96.11 |
| 5,108,146 | A * | 4/1992 | Sheppard | 296/192 |
| 5,174,066 | A * | 12/1992 | Dupuy | 49/502 |
| 5,566,954 | A * | 10/1996 | Hahn | 277/642 |
| 7,022,008 | B1 * | 4/2006 | Crocker | B60H 1/00564 237/12.3 B |

* cited by examiner

*Primary Examiner* — Troy Chambers
*Assistant Examiner* — Joshua Semick
(74) *Attorney, Agent, or Firm* — Muncy, Geissler, Olds & Lowe, P.C.

(57) ABSTRACT

A fan unit for a heat exchanger of a vehicle, has a plate-like support structure or shroud which has a main opening defining a passage for a flow of air for ventilation of the heat exchanger, and an electric fan arranged to cause the flow of air. The fan has a drive motor and an impeller connected to the motor. The support structure or shroud has a top side intended to extend at a small distance from a horizontal cross-member of the heat exchanger or the vehicle, so that an interspace is defined between them. This top side of the support structure or shroud has a flexible sealing gasket which has a configuration such that, in the assembled operating condition of the fan unit, the gasket is able to close off the interspace.

9 Claims, 3 Drawing Sheets

FAN UNIT FOR A HEAT EXCHANGER

CROSS REFERENCE TO RELATED APPLICATIONS

This non-provisional patent application claims priority under 35 U.S.C. §119(a) from Patent Application No. TO2011U000141 filed in Italy on Dec. 19, 2011.

FIELD OF THE INVENTION

This invention relates to a fan unit for a heat exchanger and in particular, to a fan unit for a heat exchanger of a motor vehicle.

BACKGROUND OF THE INVENTION

The present invention relates to a fan unit for a heat exchanger, in particular a radiator, of a motor vehicle.

More specifically the invention relates to a fan unit for a heat exchanger, of the type comprising: a plate-like support structure, or shroud, which has a main opening defining a passage for a flow of air for ventilating the heat exchanger; and an electric fan mounted on the support structure or shroud and arranged in the region of the main opening to induce the flow of air through the main opening. The fan includes an electric drive motor and an impeller connected to the motor. The plate-like support structure or shroud has a top side intended to extend at a small distance from a horizontal cross-member of the heat exchanger or the motor vehicle, so that an interspace is defined between them.

Part of the air flow produced by the electric fan escapes through the aforementioned interspace during operation and this adversely affects the overall efficiency of the fan unit.

Thus there is a desire for a fan unit which mitigates the above drawback of known fan units or at least provides a useful alternative.

SUMMARY OF THE INVENTION

Accordingly, in one aspect thereof, the present invention provides a fan unit for a heat exchanger of a motor vehicle, comprising: a plate-like support structure or shroud which has a main opening defining a passage for a flow of air for ventilation of the heat exchanger; and an electric fan mounted in the region of the main opening for inducing the flow of air and including an electric drive motor and an impeller connected to the motor; and the support structure or shroud having a top side intended to extend at a small distance from a horizontal cross-member of the heat exchanger or the motor vehicle, so that an interspace is defined between them, wherein the top side of the support structure or shroud is provided with a flexible sealing gasket having a configuration such that, in the assembled operating condition of the fan unit, the gasket is able to close off the interspace.

Preferably, the gasket comprises: a fixing profile intended to engage with a corresponding retaining formation provided along the top side of the support structure or shroud; and a lip-type sealing profile.

Preferably, the lip-type sealing profile is formed as one piece with the fixing profile.

Preferably, between the fixing profile and the sealing profile the gasket has at least one longitudinal groove suitable for defining a flexible intermediate zone.

Preferably, the flexible intermediate zone is in the form of a resilient hinge.

Preferably, the retaining formation has a cross-section substantially in the form of the digit "1" and the fixing profile of the gasket has a recessed seat with a cross-section matching that of the remote portion of the retaining formation.

Preferably, the retaining formation has transverse retaining projections which engage inside corresponding holes in a wall of the recessed seat of the fixing profile of the gasket.

Preferably, the impeller comprises a hub and a plurality of blades extending generally radially from the hub, the radially outer ends of the blades being connected to a peripheral ring.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENT

Figure 1:
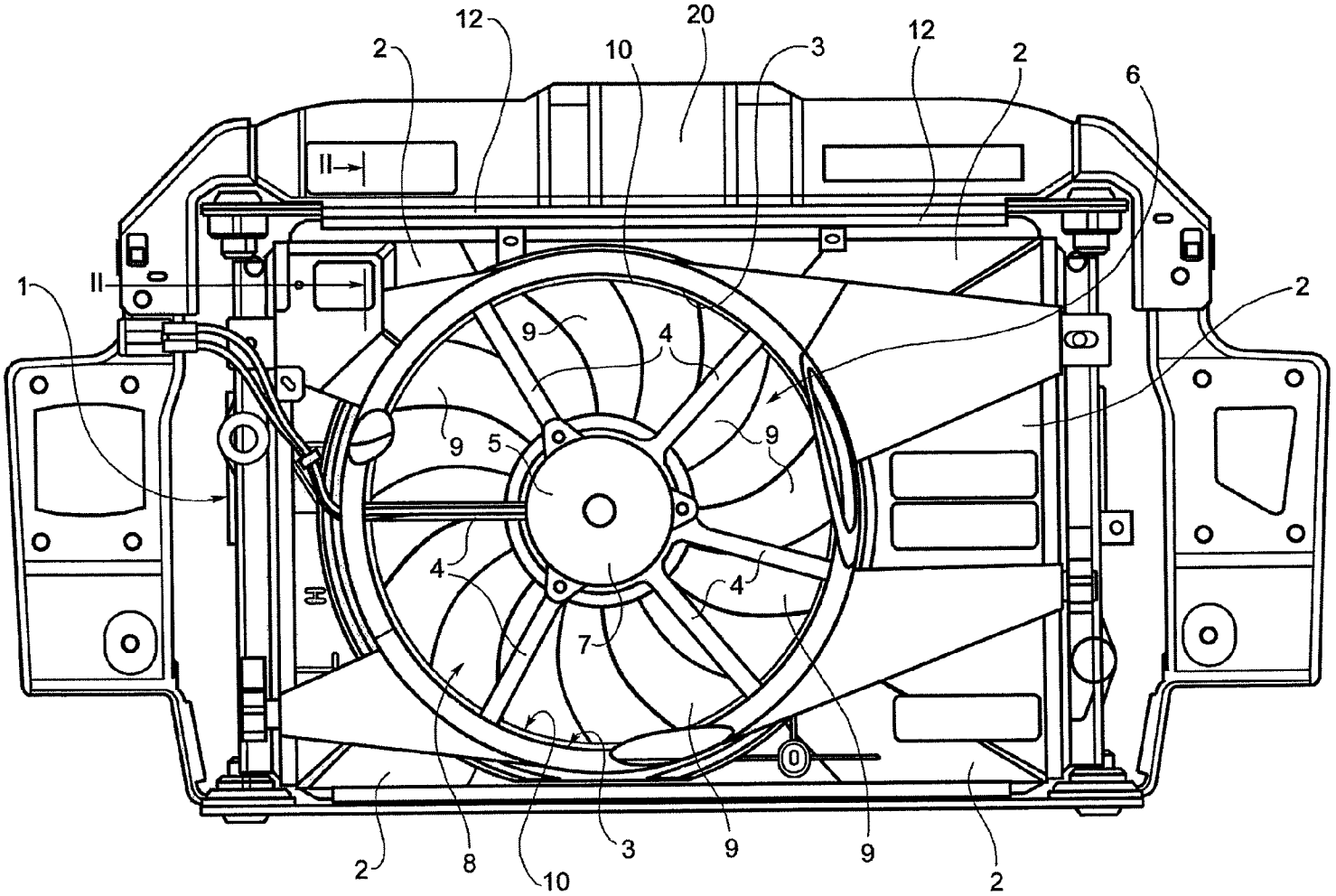
FIG. 1 is a rear elevational view of a fan unit according to the preferred embodiment of the present invention, mounted underneath a horizontal cross-member of a radiator or other structure of a motor vehicle.

In FIG. 1 the reference number 1 denotes overall a fan unit according to the preferred embodiment of the present invention for a heat exchanger, such as a radiator, of a motor vehicle. The fan unit 1 comprises essentially a plate-like support structure or shroud 2, for example made of moulded plastic, which has a main opening 3 defining a passage with an essentially circular cross-section for an air flow for ventilation of the heat exchanger. A plurality of spokes 4, which are connected to a central annular support element 5, extend from the edge of the main opening 3. These spokes 4 and the annular support element 5 are conveniently formed as one piece with the support structure or shroud 2.

The fan unit 1 also comprises an electric fan, denoted overall by 6, which is arranged inside the main opening 3. The electric fan 6 includes an electric drive motor 7 and an impeller 8, with a plurality of blades 9, connected to the motor. The radially outer ends of the blades 9 are connected to a peripheral ring 10.

Figure 2:
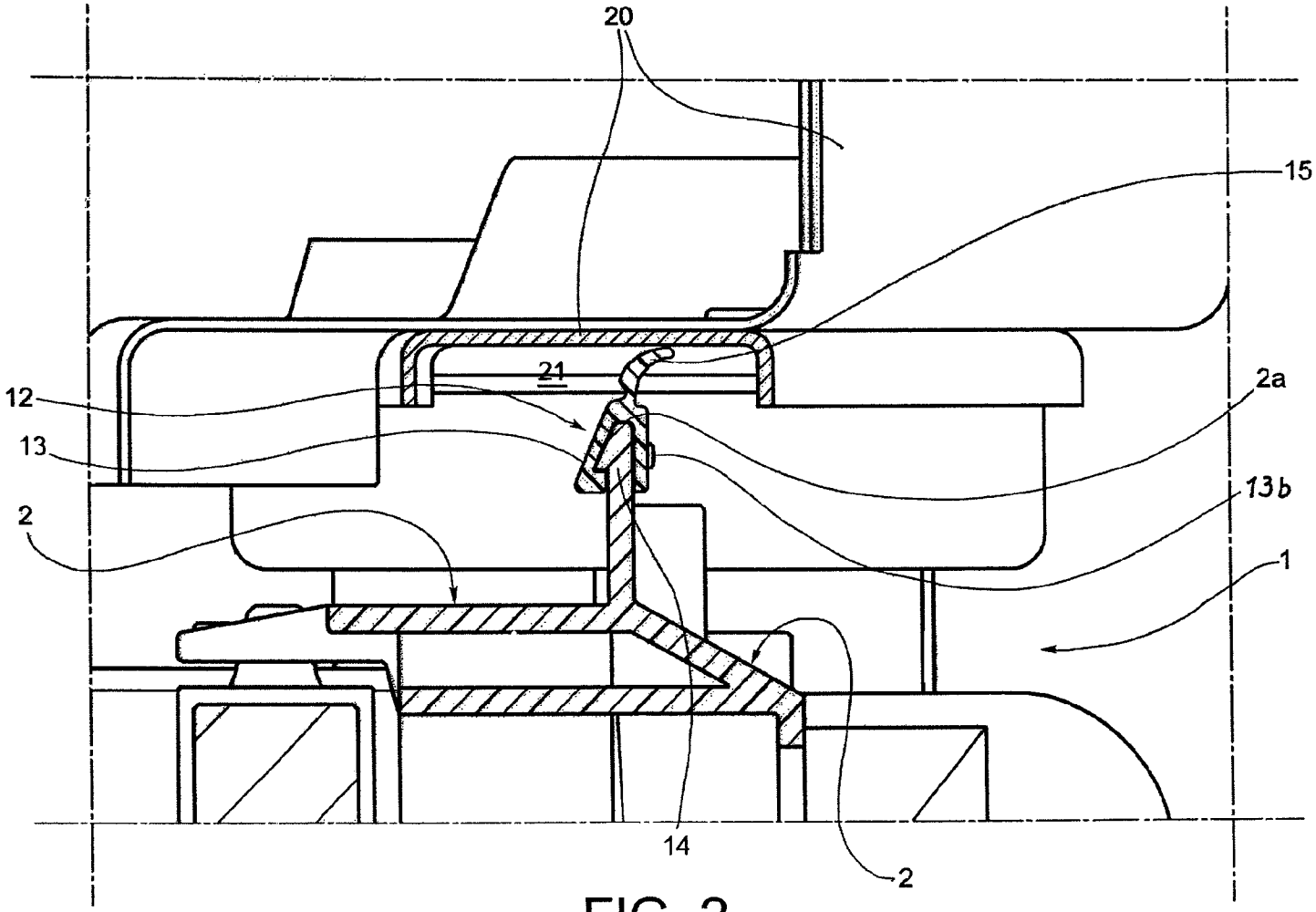
FIG. 2 is a partial cross-sectional view, on a larger scale, of the fan unit taken along the line II-II of FIG. 1.

The support structure or shroud 2 has a horizontal top side 2*a* which, in the assembled condition of the fan unit 1, extends at a small distance from a horizontal cross-member 20 (FIGS. 1 and 2) of the heat exchanger, or motor vehicle, in such a way that an interspace, indicated by 21 in FIG. 2, is formed between them. As can be seen more clearly in FIGS. 2 and 3, the aforementioned top side 2*a* of the support structure or shroud 2 is conveniently provided with a flexible sealing gasket denoted overall by 12. The gasket 12 has a configuration such that, in the assembled operating condition of the fan unit 1, it is able to close off the aforementioned interspace 21.

Figure 3:
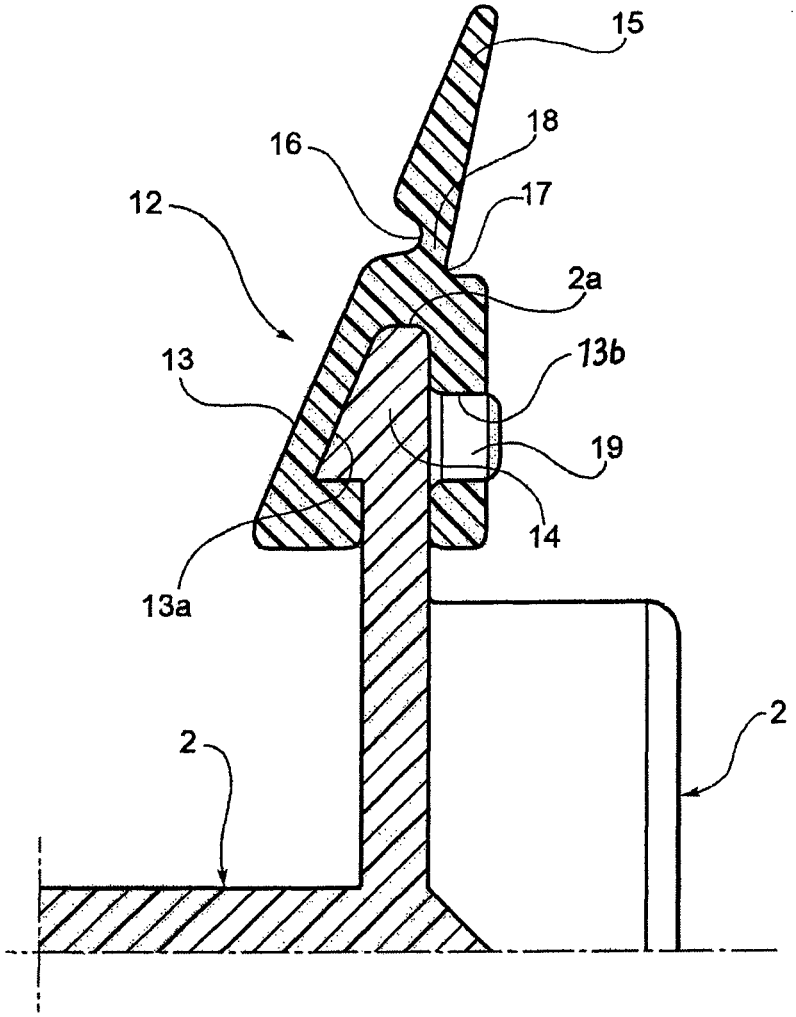
FIG. 3 is a further partial view, on a larger scale, which shows a cross-section through a gasket and an associated retaining formation.

With reference in particular to FIG. 3, in the preferred embodiment, the gasket 12 has a fixing profile 13 which is engaged with a corresponding retaining formation 14 provided along the top edge 2*a* of the support structure or shroud 2. The gasket 12 also has a sealing-lip profile 15, preferably formed as one piece with the fixing profile 13.

With reference again in particular to FIG. 3, between the fixing profile 13 and the sealing profile 15, the gasket 12 has at least one longitudinal groove 16 and preferably also an oppositely arranged longitudinal groove 17, which are suitable for defining a flexible intermediate zone 18, similar to a resilient hinge.

The retaining formation 14 has a cross-section substantially in the form of the digit "1" and the fixing profile 13 has a recessed seat 13*a* with a cross-section substantially matching that of the retaining formation 14. The retaining formation 14 may have a plurality of transverse retaining projections 19 which engage inside corresponding holes 13*b* in a wall of the recessed seat 13*a* of the fixing profile 13.

The gasket 12 may be made, for example using an elastomeric material, in particular by means of an extrusion process. The gasket 12 may be fitted onto the retaining formation 14 with extreme ease and is fixed in a stable and reliable manner.

In the operating condition, shown in FIG. 2, the lip profile 15 of the gasket 12 prevents an air flow from passing through the interspace 21. The overall operating efficiency of the fan unit 1 is therefore improved.

Although the invention is described with reference to one or more preferred embodiments, it should be appreciated by those skilled in the art that various modifications are possible. Therefore, the scope of the invention is to be determined by reference to the claims that follow.

In the description and claims of the present application, each of the verbs "comprise", "include", "contain" and "have", and variations thereof, are used in an inclusive sense, to specify the presence of the stated item but not to exclude the presence of additional items.

The invention claimed is:

1. A fan unit for a heat exchanger of a motor vehicle, comprising:

a rectangular support structure or shroud with a rim which has a main opening defining a passage for a flow of air for ventilation of the heat exchanger;

an electric fan mounted in the region of said main opening for inducing said flow of air and including an electric drive motor and an impeller connected to said motor; and said rectangular support structure or shroud having a top side intended to extend at a small distance from a horizontal cross-member of the heat exchanger or the motor vehicle, wherein an interspace is defined between the rectangular support structure or shroud and the horizontal cross-member of the heat exchanger, wherein said top side of the support structure or shroud is integrally connected with a flexible sealing gasket substantially perpendicular to said horizontal cross-member and having a configuration such that, in the assembled operating condition of the fan unit, said gasket seals only said top side of said interspace allowing air flow through all other sides of said interspace, and wherein said flexible sealing gasket is compressed longitudinally against said horizontal cross-member wherein the horizontal cross-member of the heat exchanger includes an outer rim and an inner rim, the outer rim and the inner rim each extending towards the rectangular support structure or shroud, the rim of the rectangular support structure or shroud being disposed between the outer rim and the inner rim.

2. The fan unit of claim 1, wherein said gasket comprises:

a fixing profile intended to engage with a corresponding retaining formation provided the said top side of the support structure or shroud; and a lip-type sealing profile.

3. The fan unit of claim 2, wherein said lip-type sealing profile is formed as one piece with said fixing profile.

4. The fan unit of claim 2, wherein between the fixing profile and the sealing profile, the gasket has at least one longitudinal groove suitable for defining a flexible intermediate zone.

5. The fan unit of claim 4, wherein the flexible intermediate zone is in the form of a resilient hinge.

6. The fan unit of claim 2, wherein said retaining formation has a cross-section substantially in the form of a hooked projection and the fixing profile of the gasket has a recessed seat with a cross-section matching that of a remote portion of said retaining formation.

7. The fan unit of claim 6, wherein the retaining formation has transverse retaining projections which engage inside corresponding holes in a wall of the recessed seat of the fixing profile of the gasket.

8. The fan unit of claim 1, wherein the impeller comprises a hub and a plurality of blades extending generally radially from the hub, the radially outer ends of the blades being connected to a peripheral ring.

9. The fan unit of claim 1, wherein the outer rim of the horizontal cross-member is arranged outside the rim of the rectangular support structure or shroud, and wherein the outer rim of the horizontal cross-member extends beyond the rim of the rectangular support structure or shroud.

* * * * *